United States Patent [19]

Williams, III

[11] 4,229,012

[45] Oct. 21, 1980

[54] VARIABLE BORE PACKER ASSEMBLY FOR RAM-TYPE BLOWOUT PREVENTERS

[75] Inventor: Bolie C. Williams, III, Houston, Tex.

[73] Assignee: Cameron Iron Works, Inc., Houston, Tex.

[21] Appl. No.: 901,062

[22] Filed: Apr. 28, 1978

[51] Int, Cl.[3] ..... E21B 33/06

[52] U.S. Cl. ..... 277/127; 251/1 A

[58] Field of Search ..... 277/126, 127, 129; 251/1 R, 1 A, 1 B

[56] References Cited

U.S. PATENT DOCUMENTS

| | | | |
|---|---|---|---|
| 1,695,992 | 12/1928 | Bergsten | 277/129 |
| 1,721,806 | 7/1929 | Crowell | 277/126 X |
| 3,434,729 | 3/1969 | Shaffer et al. | 277/129 X |
| 3,572,627 | 3/1971 | Jones | 251/1 |
| 3,897,039 | 7/1975 | Le Rouax | 251/1 |
| 4,044,988 | 8/1977 | Arzumanov et al. | 251/1 A |
| 4,089,532 | 5/1978 | Kamyshnikov et al. | 277/129 |

*Primary Examiner*—Martin P. Schwadron

*Assistant Examiner*—Richard Gerard

*Attorney, Agent, or Firm*—Vinson & Elkins

[57] ABSTRACT

A packer assembly for a blowout preventer having movable rams consisting of two packers, in which the packer assembly is of deformable material for sealing around a well member extending through the preventer and has a variable bore so that it will effectively seal around members, such as pipe, within a range of sizes or diameters. More particularly, each packer includes a main body of deformable material having an arcuate or curved recess with the wall defining said recess forming a sealing surface, and deformable side sealing elements or portions at each side of said recess, said side sealing elements being of a size, configuration and volume which are so related to the deformable material of the main body that when the packer assembly is moved inwardly toward and around a well member or pipe extending through the preventer, a substantially uniform radial displacement of the main body and of the side sealing elements is effected to assure uniform circumferential sealing about said object or pipe.

11 Claims, 10 Drawing Figures

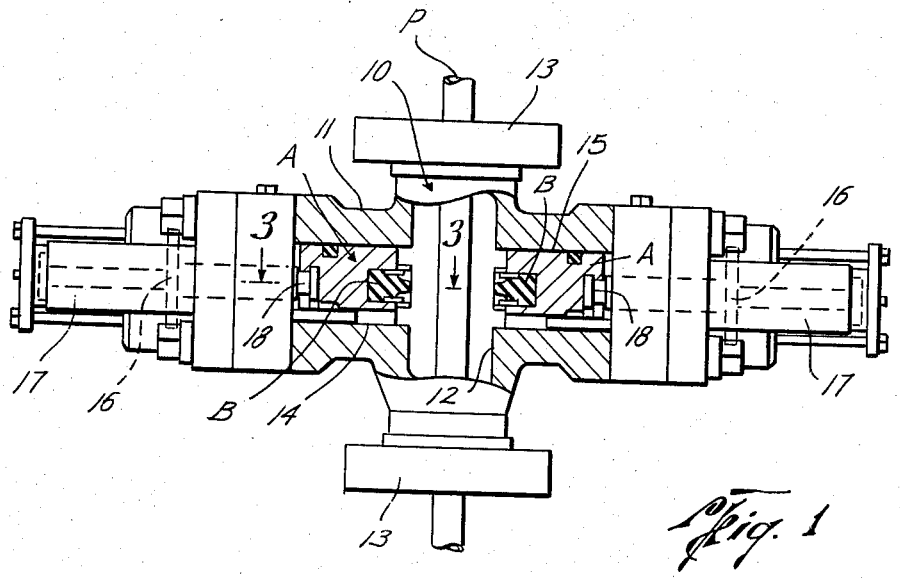
Fig. 1
Fig. 2
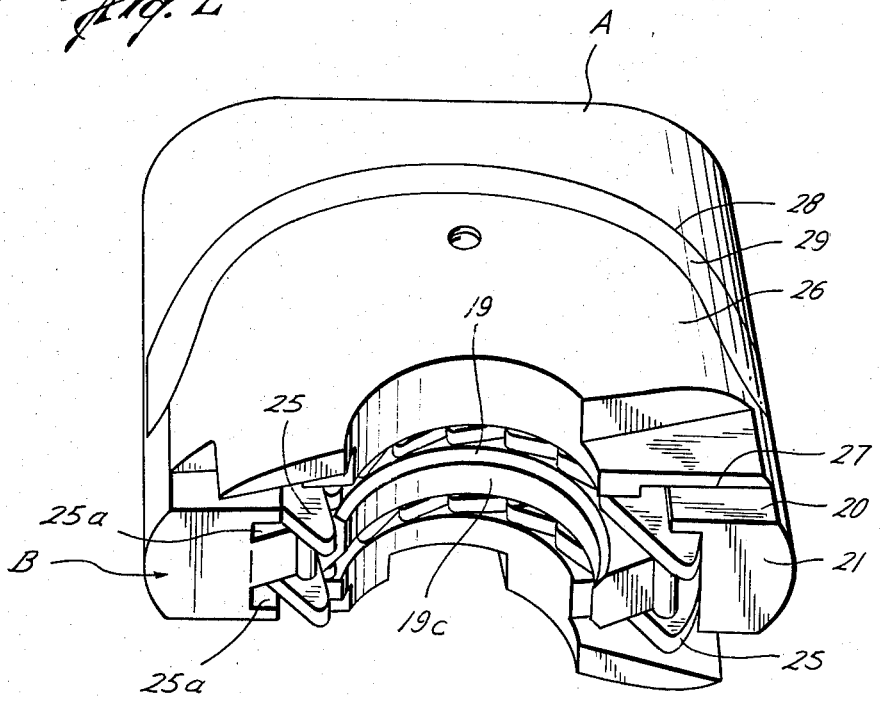

Fig. 3
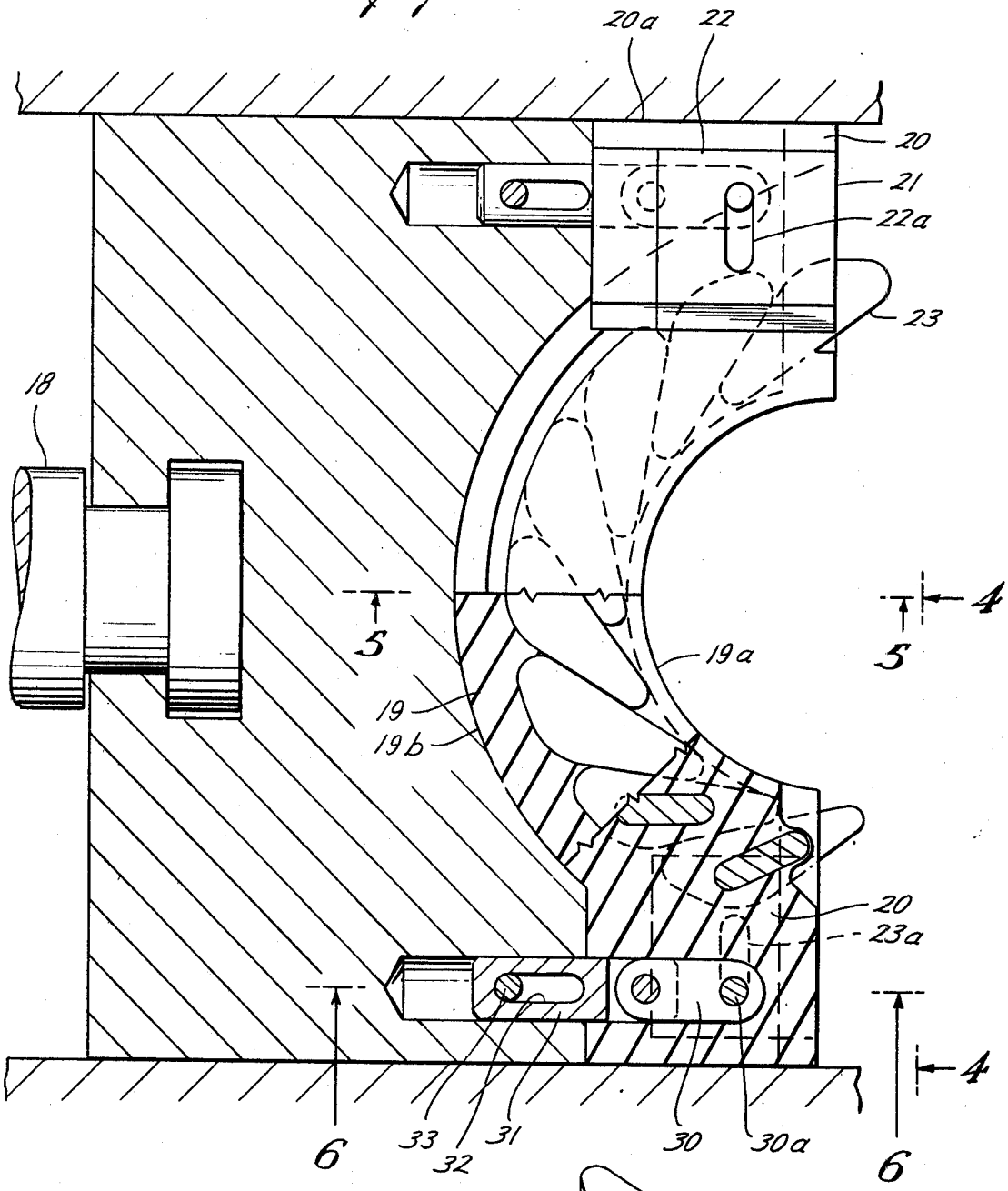
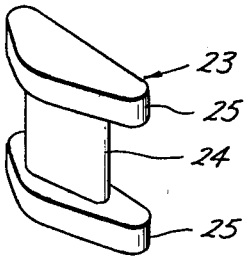
Fig. 3A

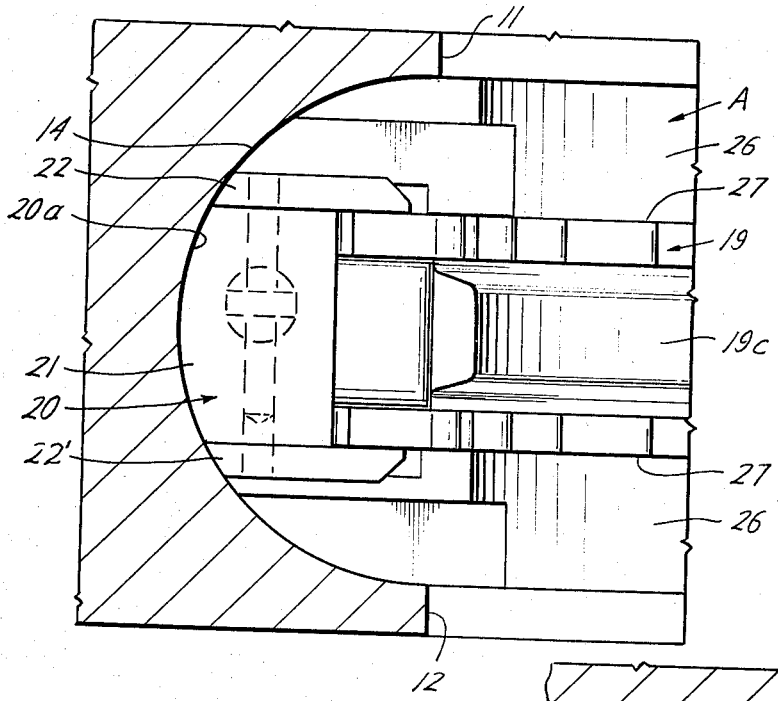
Fig. 4
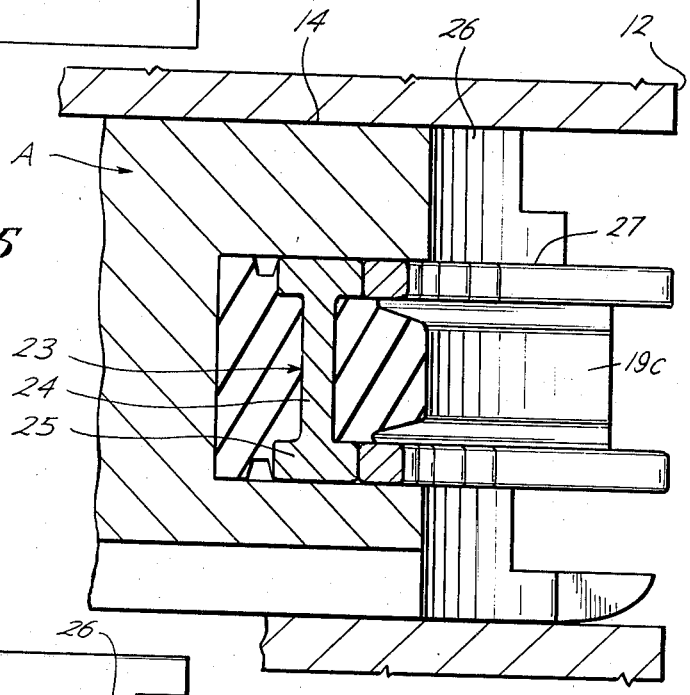
Fig. 5
Fig. 6
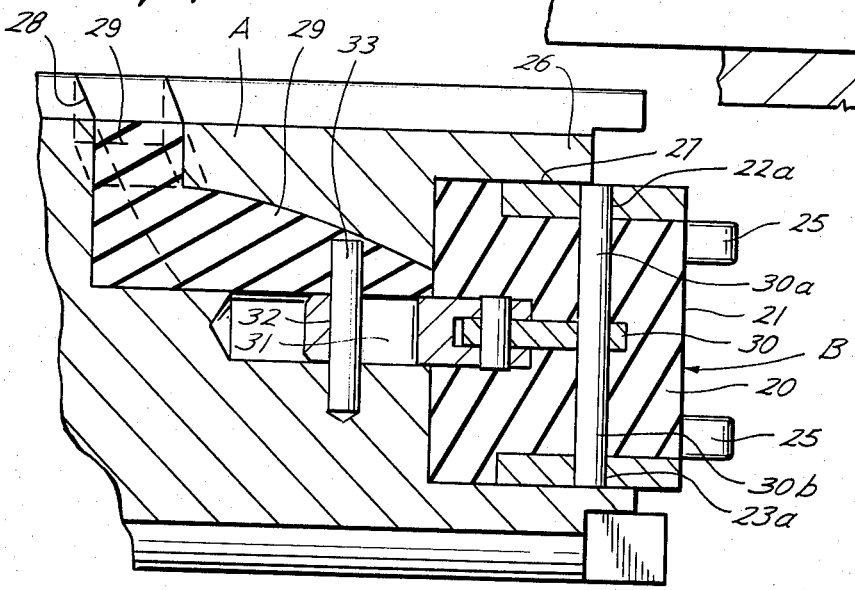

VARIABLE BORE PACKER ASSEMBLY FOR RAM-TYPE BLOWOUT PREVENTERS

BACKGROUND OF THE INVENTION

The usual well-known ram-type blowout preventer now in general use, examples of which are shown in U.S. Pat. Nos. 2,883,141, 3,272,222 and 3,434,729, can effectively seal around only one size of pipe or other object extending through the preventer. As a result, it is normal practice to keep several sets of rams on hand and change the ram size each time the pipe size is changed; this is inconvenient as well as time consuming. If the blowout preventer stack is relatively inaccessible, as in offshore drilling, it becomes necessary to include several blowout preventers in the stack so that the several different pipe sizes used in the drilling of a well may be properly sealed. Such requirement greatly increases the cost of the equipment.

Some attempts have been made to develop ram-type preventers which are capable of sealing around pipes with a range of sizes and such preventers are disclosed in U.S. Pat. Nos. 2,194,258, 2,746,710, 2,760,751, 2,855,172, 2,947,508, 3,128,077, 3,897,038, 3,915,424, 3,915,425 and 3,915,426. For one reason or another, none of these preventers have fully satisfied the need for a ram-type variable blowout preventer. For example, the structure of U.S. Pat. No. 2,194,258 included plates which are subject to being bent by the higher well pressures; U.S. Pat. No. 2,746,710 provided relatively thick cantilever beams molded into the packing material and required the application of excessive pressure to move the packing into sealing position, thereby resulting in undue wear of the packing material; in U.S. Pat. No. 2,760,751, the swinging plates provide insufficient support to resist the pressures encountered in well drilling; U.S. Pat. No. 2,855,172 utilizes parallel separate rams but this imposes a severe strain on the packing material at the point where the pipe rubs during working; although showing an equalizer consisting of small rigid balls, U.S. Pat. No. 2,947,508 has disadvantages similar to U.S. Pat. No. 2,855,172; U.S. Pat. No. 3,128,077 has very low pressure capability, as well as an uneven distribution of force application to the sealing sleeve; U.S. Pat. Nos. 3,897,038, 3,915,424, 3,915,425 and 3,915,426 are objectionable because they provide complex anti-extrusion members which are difficult and expensive to manufacture. A serious shortcoming, which the present invention is directed to overcoming, of previous ram-type variable bore preventers, is the distortion of the circular relaxed shape of the sealing member to a more oval shape as the sealing members are urged toward and against the well member extending therethrough.

Aside from the ram-type, annular blowout preventers have been developed which are capable of sealing around different sizes of pipe. U.S. Pat. Nos. 3,572,627, 3,897,039, 3,897,040, 3,897,071 and 4,007,904 disclose annular blowout preventers. However, all annular blowout preventers have the disadvantage of requiring a large amount of strain energy to be stored in the packer element prior to applying the energy required to effect sealing pressure with the pipe or object and this is particularly evident when sealing about the smaller sizes of a pipe or object.

In spite of the many attempts to provide ram-type blowout preventers capable of effectively sealing around a range of pipe sizes against the relatively high pressures commonly encountered during drilling operations, there is no ram-type preventer presently available to fully satisfy this need.

SUMMARY

This invention relates to a ram-type blowout preventer for sealing around well members or pipes within a range of sizes and shapes. More particularly, it relates to an improved packer assembly for such blowout preventer for applying a uniform sealing pressure circumferentially around any well member within the size range of the preventer.

The invention provides a variable bore packer assembly for use in a ram-type blowout preventer which comprises two packers, each of which includes a main body portion having a recess on its front face and side sealing portions on each side of the main body portion, with the packers being adapted to coact with each other to seal around well members or pipes within a predetermined range of sizes. The packers are mounted in rams movable within the standard blowout preventer and are controlled by operation of said rams.

It is one object of the invention to provide a packer assembly for a ram-type blowout preventer which is adapted to be mounted in rams movable in the usual guideways or bores of a standard blowout preventer, said assembly having a variable bore which efficiently seals around pipes within a selected range of sizes against the pressures encountered in normal drilling operations.

Another object is to provide a pair of coacting packers for use in a standard ram-type blowout preventer, wherein each packer comprises a main body of a deformable material having a recess in its front face which may be substantially semi-circular and side sealing elements or portions also of deformable material at each side of the recess, with said side sealing elements being so disposed and of such volume in relationship to the volume of the main body that the application of force by the rams to the packers displaces the material of the side sealing elements and main body to move the surface which defines the recess of the main body substantially uniformly toward and into sealing contact with a well pipe. The side sealing elements being so constructed that the required volume is provided without the necessity of increasing the size of the standard blowout preventer or of the rams in which the packers are mounted.

Still another object is to provide a packer assembly for use in the ram of a blowout preventer including packers, each of which is formed of a main body of resilient material having a substantially semi-circular sealing surface in its front face for engaging and sealing around the well pipe and side sealing elements or portions of resilient material at the extremities of said main body; each packer also including reinforcing inserts within the resilient material of the packer and of a design to not only reinforce the assembly and prevent vertical extrusion of the resilient material of the packer under high pressures but also to assist in controlling the desired uniform radial movement of the semi-circular sealing surface toward and into uniform sealing contact with the well pipe.

BRIEF DESCRIPTION OF THE DRAWINGS

In the drawings wherein like numerals indicate like parts, and wherein an illustrative embodiment of this invention is shown:

FIG. 1 is a view, partly in section and partly in elevation, of a blowout preventer having a variable bore ram structure, constructed in accordance with the invention, and showing the rams in open position.

FIG. 2 is an isometric view of one of the rams having a packer mounted therein and showing the front face of the ram and packer.

FIG. 3 is an enlarged horizontal cross-sectional view taken on the line 3—3 of FIG. 1 and illustrating one of the packers with portions thereof broken away to more clearly show the structure.

FIG. 3A is an isometric view of one of the reinforcing inserts, a number of which are embedded in each packer.

FIG. 4 is a vertical sectional view taken on the line 4—4 of FIG. 3.

FIG. 5 is a vertical sectional view taken on the line 5—5 of FIG. 3.

FIG. 6 is a vertical sectional view, taken on the line 6—6 of FIG. 3 and illustrating the connection between each ram and its packer.

DESCRIPTION OF PREFERRED EMBODIMENT

Figure 7:
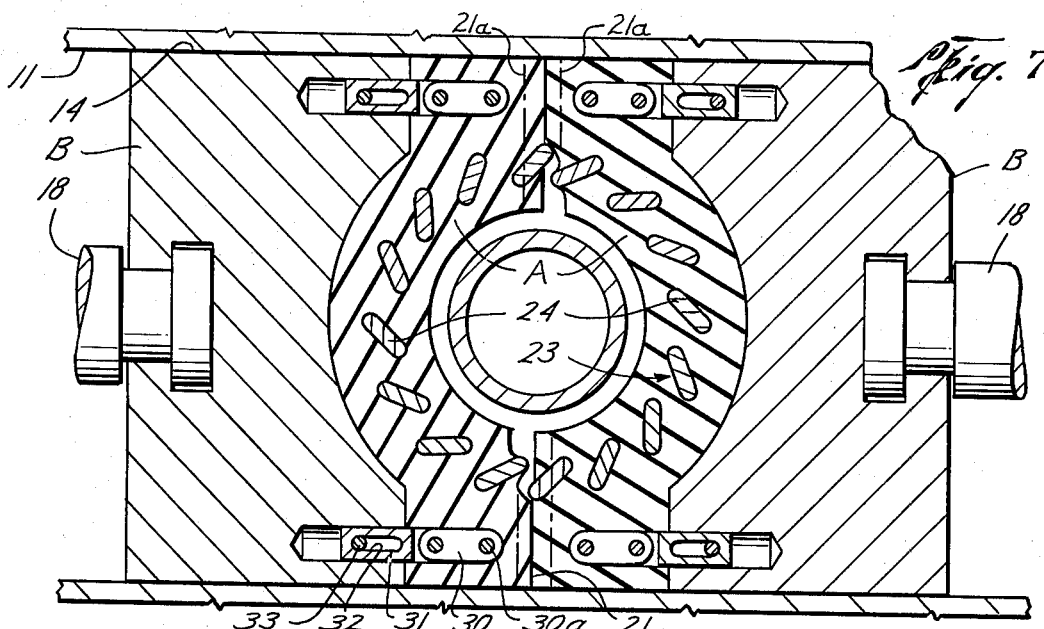
FIG. 7 is a horizontal cross-sectional view showing the two rams and packer assembly when the packers of the assembly are first moved into contact and prior to the time that said packers seal around a pipe member extending through the blowout preventer.

In the drawings (FIG. 1), the numeral 10 designates a standard ram-type blowout preventer which includes a body 11 having a vertical bore 12 extending therethrough. Flanges 13 at the upper and lower ends of the preventer permit the same to be readily connected in a blowout preventer stack on a well. In one side of the body is a horizontal bore or guideway 14 within which a ram A is movable. The guideway communicates with the vertical bore 12 so that a packer B carried by the forward end of the ram may be moved inwardly to seal around a well pipe P which extends through said bore. Axially aligned with the horizontal guideway 14 is a similar bore or guideway 15 located on the opposite side of the body and also in communication with the vertical bore 12. The guideway 15 is adapted to receive a similar ram A and packer B.

For purposes of this description, the surface of each ram facing toward the vertical bore 12 will be referred to as the front face and as shown, each packer B is mounted in such face. The two packers which coact to perform the sealing, as will be explained, are referred to herein as the packer assembly.

The rams A are in axial alignment and each is movable to move the packer assembly into and out of sealing position with the well pipe P by means of a piston 16 which is slidable within a cylinder 17. A piston rod 18 extending from each piston is connected to the rear or outer face of its respective ram and preferably the pistons are hydraulically actuated. The general construction of the blowout preventer and the use of hydraulically actuated pistons for operating the rams is in accordance with the usual practice and forms no particular part of the present invention; therefore, the specific arrangement of the preventer, the operating pistons and the hydraulic system are subject to variation.

The present invention resides in an improved packer assembly and the mounting of its packers within the rams A. The two packers may be of identical construction and coact with each other when they are moved inwardly to form a circular packing seal around the well pipe P. The packers are moved into and out of sealing position by the rams A.

As shown in FIGS. 3 and 4, each packer includes a main body portion 19 of resilient or deformable material having a recess 19*a* in its front face. The back face 19*b* of the packer assembly is preferably concentric with the recess in the front face but this is not essential. The recessed portion in the front face is formed with a semi-circular sealing surface 19*c* (FIG. 4) which, as will be explained, is adapted to move into engagement with the well pipe to seal therearound.

Side sealing elements or portions 20 also of resilient or deformable material are formed at each side of the main body portion and each has a flat sealing face 21 directed inwardly toward the bore 12 and facing the other packer. The side sealing elements are preferably integral with the resilient material of the body portion 19 but could be molded separately.

To confine each side sealing element or portion 20 against upward and downward displacement upon the application of force to the assembly, upper plates 22 are molded on the top of said side portions, while lower plates 23 are molded on the bottom thereof (FIG. 3). The surface 20*a* of each side sealing element may be slightly curved, as is shown in FIG. 4, with such curvature following the curvature of each bore or guideway 14 and 15 in the preventer body and within which each ram A is movable.

A plurality of relatively rigid reinforcing elements or inserts 23 are disposed within the resilient material of the main body portion 19 of the packer assembly. Each element or insert is preferably bonded to the resilient material of the main body of the packer and includes an upright rib 24 having a flange 25 at each end which overhangs the rib on all sides (FIG. 3A). The ribs are disposed about the semi-circular sealing surface 19*c* of the front face of the packer body and preferably the edges of the flanges 25 abut or contact each other in the manner shown in FIG. 3.

When the packer body 19 is in a normal undeformed position, that is, the packer is unconstricted, the flanges 25 of the inserts are skewed with respect to the bore of the packer. When a pressure is applied to the back face 19*b* of the main body portion 19, the sealing surface 19*c* of the recess will move radially inwardly at a greater rate than the outer portions adjacent the back face 19*b* and such movement causes the rigid inserts 23 which are bonded to the resilient material to swing their flanges 25 to a more radial orientation with respect to the packer bore. The movement and pattern of these circularly arranged rigid inserts provides a means for preventing extrusion of the resilient material in a vertical direction by higher pressures after the packers have moved into sealing position. Also, it is believed that the particular arrangement of inserts and their manner of movement assists in maintaining the surface 19*c* in a semi-circular shape as the same is being moved toward sealing position. After sealing position is reached, the inserts function to assist in applying uniform sealing pressure to the well member or pipe.

The manner in which the inserts 23 move when the packer assemblies are moved inwardly and their action in preventing extrusion is explained in detail in the prior patent to Jones and Baugh U.S. Pat. No. 3,572,627, wherein such inserts are employed in an annular blowout preventer.

As shown in FIG. 4, each ram A is generally oval in cross-section and is movable within its respective guideway 14 or 15 in the blowout preventer housing. The ram A is similar to standard rams for the particular blowout preventer and comprises a body 26 having a horizontal slot 27 in its front face. The ram is modified only to the extent necessary to receive the packer. An external groove 28 is formed in the outer surface of each ram and a sealing ring 29 is disposed within this groove for sealing between the exterior of the ram and its horizontal guideway 14 or 15.

Each packer B is mounted on the front face of its ram A by sliding the same within the horizontal slot 27 (FIGS. 1 and 5). The packer is secured within the slot by means of a connecting structure which includes a flat link 30 molded within each side portion 20 (FIGS. 3 and 6). The link includes an upstanding pin 30*a* and a downwardly extending pin 30*b*, and the extremities of these pins are movable within slots 22*a* and 23*a* formed in the upper and lower confining plates 22 and 22'. The rear end of the link is pivotally connected by a pin and slot connection with a second link 31. Such link has its forward end molded within the side portion and is provided with a rear slot 32. The slot 32 receives a securing pin 33 which extends downwardly from the external ram packing 29. Since the pin 33 is secured to the inner surface of the ram packing and extends downwardly through an opening in the ram and then into the link 31, the front packer assembly is secured to the ram through the links 30 and 31.

The provision of the connecting structure including the links permits limited inward movement or displacement of the side portions and their plates whereby bending of any of the connecting parts is eliminated. Although the linkage arrangement is desirable, it is not absolutely necessary to the function of the invention because although the side portions undergo lateral movement, such lateral movement is not extremely excessive.

It is noted that rams similar to the above described type, together with an external seal having retaining pins such as pins 33, are generally well known in the art; also, it has been the practice to provide slots in the front face of a ram to receive a packer, and, therefore, the specific construction of the ram, its sealing means and other details are subject to variation. So long as it is provided with a slot or recess which will receive the packer of this invention, the ram is satisfactory. Of importance is the fact that the ram operates within the usual guideway of the standard blowout preventer of a selected size since this eliminates the need for special blowout preventers in order to use the packer assembly herein described.

When the packers are in place secured to the rams, operation of the rams will move said packers toward a well pipe or member which is extending through the blowout preventer 10. The two packers forming the packer assembly are moved inwardly toward each other until the sealing faces 21 of the side sealing elements or portions of one packer engage those of the other. So that the two packers will properly interfit with each other and allow the sealing faces 21 to contact, the flanges 25 of those inserts 23 of each packer closest to the side sealing elements 20 extend beyond the sealing faces 21 as shown and each packer is formed with complementary recesses 25*a* for receiving the projecting portions of the flanges of the opposite packer assembly.

The packer assembly is adapted to seal about a range of sizes of the well pipe or member which extends through the blowout preventer. In order to accomplish this, each packer moves radially inwardly to accomplish its sealing function and operation of the packers in sealing around a pipe is shown in FIGS. 7, 8 and 9.

Figure 8:
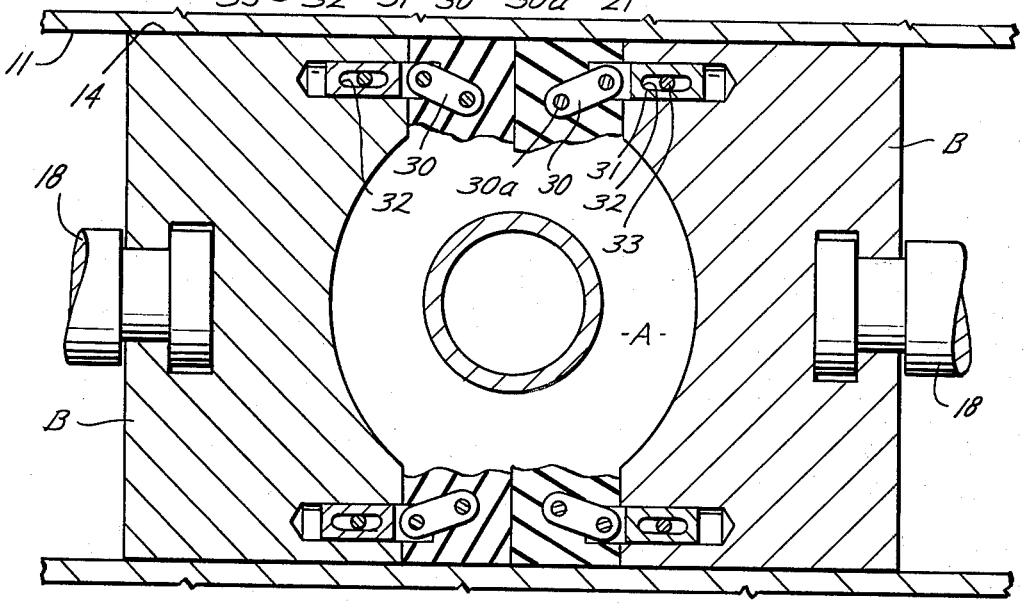
FIG. 8 is a view similar to FIG. 7 and illustrating the position of the packers after they have been moved into sealing engagement with the pipe member.

Referring to FIG. 7, each packer is illustrated as having been moved inwardly so that the sealing faces 21 of the end portions 20 are in contact with each other but no pressure has been applied to the resilient material of either the body portion or the side sealing portions. Up to this point, the resilient material of the packers has not been subjected to any appreciable force and there is no strain energy stored in said resilient material.

Figure 9:
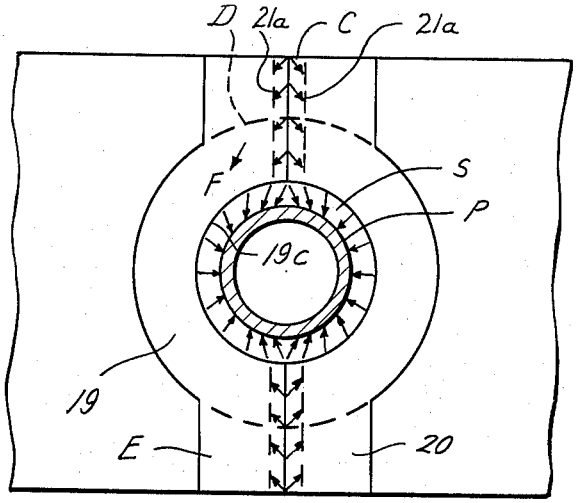
FIG. 9 is a generally schematic view, illustrating the initial contact between the packers as they are moved toward sealing position and showing the movement thereafter of the deformable material relative to the packers.

The position of the packers, as illustrated in FIG. 7, is shown schematically in FIG. 9. Each side portion of each packer has a volume of resilient material between each sealing face 21 and the dotted line 21*a*, such volume of material being designated by the letter C. The sealing face 21 is quite wide and it is preferred that substantially all of the volume C project forwardly from the metallic parts of the rams so that initial pressure will be applied to said faces 21.

The external surface of the pipe P is spaced from the sealing surface 19*c* of the main body portion 19 of the packer to form a continuous annular space S around the pipe. To effect sealing with the pipe, there must be sufficient volume of material in the body portion 19 and in the side portions 20 which can be displaced to fill said space S. It has been the prior practice in variable bore rams to construct each body portion generally semi-circular in cross-section rather than with the side portions 20. However, when this is done, the volume C is greatly reduced with the result that the material in the side members available for displacement into the space S, when combined with the displaced material of the main body, is not sufficient to fill said space and form an effective seal.

To provide sufficient volume of material for displacement into the space S, the packer augments the volume C to that shown in FIG. 9 by providing the side portions 20 which are outside what would normally be a continuous circumferential back face as indicated by dotted lines D, of the packer. This additional volume is designated E in FIG. 9. The particular advantage of providing the volumes C and E is to provide sufficient volume for displacement without having to provide a larger ram, or more importantly, a larger size of blowout preventer. Thus, the packers and their respective rams may be used with standard blowout preventers in the usual, well-known sizes.

After the two packers have been moved into the position shown in FIGS. 7 and 9 where their respective sealing faces 21 are in contact, the continued application of force to the resilient material of the packers by the rams will result in a displacement of the volumes C in a direction indicated by the arrows F. This causes a flattening of the volumes C and at the same time the resilient material of the main body portion 19 including the material defining the semi-circular sealing surface 19*c* is being displaced inwardly. By relating the volume of the side areas with the volume of material which is being displaced inwardly along the semi-circular surface 19c, the semi-circular sealing surface 19c is caused to undergo movement in a direction toward the well pipe, whereby the annular or circumferential space S between the packers and the pipe is filled by the displaced resilient material. It is believed that the semi-circular surface 19c, even though being reduced in size, substantially maintains its semi-circular shape and such maintenance is also assisted by the pattern of the circularly arranged, relatively rigid reinforcing elements 23.

The coaction of the packers with each other as force is applied to the back face 19a of the body portion 19 also results in the movement of the reinforcing elements 23 to a more radial position so that as the diameter of the opening formed by the two packers is reduced, the reinforcing elements are swung to locate their flanges 25 in a position to prevent extrusion of the resilient material of the packers after the packers are in sealing position around the pipe. The inner sealing surface 19c of each packer moves inwardly until it engages the particular size of pipe P which is extending through the preventer. Thereafter, the continued application of force to the packers results in a substantially uniform circumferential sealing contact between the sealing surface 19c of each packer and the well pipe P.

Since each packer is carried by one of the blowout preventer rams, there is no need to store strain energy within the resilient packing material until such time as the forward sealing surfaces 21 of the side sealing portions 20 engage each other. In the case of annular blowout preventers, such as shown in the Jones et al U.S. Pat. No. 3,572,627, a substantial storage of strain energy results long before the annular blowout preventer contacts the well pipe to perform its sealing action. The present structure provides all the advantages of a variable bore so that pipe sizes within a given range may be sealed, and further retains all of the advantages of the usual ram-type preventer.

The particular type of inserts 23 shown herein have been found satisfactory but various other types could be employed. So long as inserts of relatively rigid material are disposed within the resilient material of each packer in a manner to prevent extrusion of the packer material under high pressures, the purposes of the present invention will be accomplished.

The relationship between the volumes of each side portion 20 and the volume of the resilient packing material of the body portion 19 will determine, to some extent, the size ranges which can be sealed. It has been found that satisfactory results are obtained when the volume of resilient material available for displacement from the side portions 20 is so related to the volume of material available for displacement in the main body, that together these volumes fill the annular space S between the packers and the pipe diameters within the selected range. By providing sufficient volume in the side members, the inward displacement thereof coacts with the inward displacement of the resilient material of the main body portion 19 to properly reduce the semi-circular size of the sealing surfaces of the packers. Additionally, when sealing surface 19c contacts and engages the pipe, it applies a uniform pressure, which results in an even wear of the sealing surfaces in engagement with the pipe and an ability to seal efficiently against the pressures encountered during drilling.

Experience has shown that a fairly wide range of sizes may be handled by each standard blowout preventer. Examples of the blowout preventer size and the range which packer assemblies, constructed in accordance with this invention may handle satisfactorily are as follows:

| BLOWOUT PREVENTER SIZE | PIPE SIZE RANGES |
|---|---|
| 18¾" bore | 7⅝"–3½" |
| 16¾" bore | 7"–3½" |
| 13⅝" bore (uses 2 | 7"–5" |
| packer sizes) | 5"–2⅞" |
| 11" bore | 5"–2⅞" |

The range of pipe sizes which each size of blowout preventer can seal, as has been explained, is related to the volume of material available for displacement from the side portions 20 and the main body portion 19.

Because the packer assemblies are confined within the blowout preventer housing when in use, the side sealing elements or portions 20 need not be integral with the main body portion 19; they could be molded as separate sections which would be placed in position and confined within the bore in which the ram operates. Their volume and size relationship to the material in the main body portion would be as described and the function and operation would be the same.

What is claimed is:

1. A packer assembly for use in a variable bore, ram-type blowout preventer and adapted to be mounted in the front faces of the rams of said preventer, said assembly including, a pair of packers coacting with each other to encircle and seal around a well member within a preselected size range extending through the blowout preventer, each packer comprising, a main body portion of resilient material having a recess in its front face, the front face which defines the recess forming a sealing surface engageable with the exterior of the well member when the resilient material of the main body portion is displaced in a direction to move said sealing surface into contact with such member, side sealing portions of resilient material on each side of the main body portion and located adjacent the sides of the front face of the recess, said side sealing portions having a volume of resilient material which is displaced radially inward when a force is applied to the assembly to move the sealing surface of said recess toward sealing position with the well member, connecting means extending from each side sealing portion of the packer to the ram for that respective packer, said connecting means being sufficiently yieldable rearwardly and laterally to allow the displacement of the material of said side sealing portions into sealing position, said displaced volume of material of the side portions being so related to the volume of material in the main body portion which is displaced as the main body portion is moved toward sealing position that the combined volumes fill the space between the packer and the particular size of a well member which extends through the blowout preventer to effect a sealing contact with said member, a plurality of relatively rigid reinforcing inserts in the main body portion of each packer and arranged in a generally semi-circular path, said inserts coacting with each other as the resilient material of the main body portion is displaced toward the well member to prevent extrusion of the resilient material in a vertical direction along the well member after the resilient material has engaged said member.

2. A packer assembly for use in a variable bore, ram-type blowout preventer and adapted to be mounted in the front faces of the rams of said preventer, said assembly including, a pair of packers coacting with each other to encircle and seal around a well member within a preselected size range extending through the blowout preventer, each packer comprising, a main body portion of resilient material having a recess in its front face, the front face which defines the recess forming a sealing surface engagable with the exterior of the well member when the resilient material of the main body portion is displaced in a direction to move said sealing surface into contact with such member, side sealing portions of resilient material on each side of the main body portion and located adjacent the sides of the front face of the recess, said side sealing portions having a volume of resilient material which is displaced radially inward when a force is applied to the assembly to move the sealing surface of said recess toward sealing position with the well member, metal plates positioned above and below said side sealing portions, a pin extending through each of said side sealing portions and into said plates, means extending from the rear of said side sealing packers for connecting to the packer ram, said connecting means and said pins having sufficient mobility to allow the displacement of the material of said side sealing portions into sealing position, said displaced volume of material of the side portions being so related to the volume of material in the main body portion which is displaced as the main body portion is moved toward sealing position that the combined volumes fill the space between the packer and the particular size of well member which extends through the blowout preventer to effect a sealing contact with said member, and a plurality of relatively rigid reinforcing inserts in the main body portion of each packer and arranged in a generally semi-circular path, said inserts coacting with each other as the resilient material of the main body portion is displaced toward the well member to prevent extrusion of the resilient material in a vertical direction along the well member after the resilient material has engaged said member.

3. A packer assembly according to claim 2 wherein, the ends of said pins are positioned in slots in said metal plates.

4. A packer assembly according to claim 2 wherein said connecting means includes, a transversely movable pivoting linkage connected to each of said pins, and a lost motion connection between said pivoting linkage and said ram.

5. The combination with a pair of rams which are movable within guideways of a variable bore blowout preventer and which have horizontal transversely disposed slots on the front thereof, of a packer assembly mounted in said slot comprising, a packer in each packer assembly, each packer including means sealing between the upper surface of the ram and the guideways, a main body portion of resilient material having a recess in the front thereof, a sealing surface on the front face of the recess, a side sealing portion of resilient material on each side of the body portion and adjacent to its front area, means for confining each side sealing portion whereby displacement of the resilient material of said side portion is in a substantially radially inward direction relative to the body portion of its packer, and means for confining the main body of each packer against upward, lower or rearward displacement, whereby forces applied thereto will displace the sealing surface on the front face of the recess in a direction toward the vertical axis of the blowout preventer, each side sealing portion having a front sealing surface which projects forwardly from the sealing surface of said recess when the side portions are in their normal undeformed condition, connecting means extending from each side sealing portion of the packer to each ram for that respective packer, said connecting means having sufficient mobility with respect to its packer to allow the displacement of the material of said side sealing portions into sealing position, said body confining means including a plurality of relatively rigid reinforcing inserts in the main body portion of each packer arranged in a generally semi-circular path, said inserts coacting with each other as the resilient material of the main body portion is displaced to maintain them in a position which will prevent extrusion of the resilient material in a vertical direction after the packers are moved to sealing position around a well member extending through the blowout preventer.

6. The combination as set forth in claim 5, wherein said inserts are disposed to have their radially innermost ends substantially adjacent the sealing surface of the main body when the body is in non-sealing position, said elements coacting with each other so that their effective radial lengths increase as the main body portion is moved inwardly toward said well member.

7. A variable bore ram type blowout preventer comprising, a housing having a vertical bore through which a well member may extend, a pair of axially aligned horizontal ram guideways on opposite sides of said vertical bore and communicating therewith, a ram in each guideway movable axially therein, seal means mounted in the top of each ram for sealing against said guideway, a packer mounted in the front of each ram, said packers coacting with each other when moved inwardly around the well member to form a seal about said well member, each packer including, a main body portion of resilient material having a recess of generally semi-circular shape in its front, a generally semi-circular sealing surface on the front face which defines the recess and is engagable with the outer surface of the well member to seal around the member when the main body portion is moved into contact with such member, side sealing portions of resilient material on each side of the main body portion and located adjacent the forward end areas of the recess, said side sealing portions having a volume which provides for a predetermined displacement of resilient material radially inward of the recess when a force is applied to the packer to move said recess toward sealing position with the well member, said predetermined displacement being so related to the volume of material which is displaced from the main body portion as said body is moved inwardly toward the well member that the space between the sealing surface on the front face and the well member is filled to thereby effect a sealing contact with the well member, connecting means extending from each side sealing portion of the packer to each packer ram for that respective packer, said connecting means being yieldable rearwardly and laterally to allow the displacement of the material of said side sealing portions to sealing position, a plurality of reinforcing inserts in the main body portion of each packer arranged in a generally semi-circular arrangement, said inserts coacting with each other as the resilient material of the main body portion is displaced toward the well member to prevent vertical extrusion of the resilient material and to assist in maintaining the recess in substantially a semi-circular shape throughout all positions of its movement.

8. For use in a variable bore blowout preventer ram having packer receiving means in its front face, a packer having a portion adapted to be received by said receiving means, said packer comprising, a body of resilient material having a semi-circularly recessed front face disposed between two side portions, a plurality of reinforcing elements arranged in a semi-circular pattern carried by the body adjacent the recess front face, a volume of resilient material in at least one side portion available for displacement into the space between the recessed front face and a well member extending through the blowout preventer, whereby said volume together with the volume of resilient material displaced from the body will move the front face of the body into sealing contact with the well member with substantially uniform sealing pressure thereabout, and connecting means extending from each side sealing portion of the packer to the ram, said connecting means having sufficient mobility with respect to its packer to allow the displacement of the material of said side sealing portins to sealing position.

9. A packer for use in a blowout preventer ram as set forth in claim 8, wherein the reinforcing elements are embedded within the main body portion and have enlarged ends to prevent vertical displacement of the resilient material.

10. A packer for use in a blowout preventer ram as set forth in claim 9, wherein said reinforcing elements coact with each other to assist in maintaining a uniform radial movement of the recessed front face of the body of resilient material when force is applied to said body.

11. A packer assembly for use in a variable bore ram-type blowout preventer and mountable on the front faces of the rams thereof, comprising a pair of packers coacting to seal around a well member extending through the preventer, each packer including resilient means for sealing with the well member, the preventer housing and an opposite packer, relatively rigid members imbedded in the resilient means in semi-circular array and adapted to move toward sealing position with the resilient means to substantially bridge the gap between the ram and a well member and thereby restrain extrusion to the resilient member, and means for connecting each packer to a ram, said means being partially imbedded in side portions of the resilient means and being yieldable rearwardly and laterally in response to movement of said side portions, said connecting means being disposed one in each side portion of the resilient means, and each one including a vertical pin whose ends are movable in transverse slots in upper and lower confining plates and a pair of pivoted links for connection of the pin to the ram.

* * * * *